United States Patent [19]

Parker

[11] 4,161,310

[45] Jul. 17, 1979

[54] METAL FENCE POST PULLER

[76] Inventor: Merrill D. Parker, Box 46, Rufus, Oreg. 97050

[21] Appl. No.: 918,036

[22] Filed: Jun. 22, 1978

[51] Int. Cl.[2] ..... E21B 19/00

[52] U.S. Cl. ..... 254/30

[58] Field of Search ..... 254/30, 132, 31

[56] References Cited

U.S. PATENT DOCUMENTS 2,377,652 6/1945 Sanders ..... 254/132

FOREIGN PATENT DOCUMENTS 900982 7/1962 United Kingdom ..... 254/30

*Primary Examiner*—Robert C. Watson

*Attorney, Agent, or Firm*—Daniel Jay Tick

[57] ABSTRACT

An elongated bar is pivotally affixed at one end thereof to one end of a shaft-like support member for rotation in the plane of the bar and the support member in directions toward and away from the support member. A base plate affixed to the opposite end of the support member supports it in upright position adjacent a metal fence post. A rod-like cross member is affixed to the bar at the pivoted end thereof and extends perpendicularly thereto. A coupling device couples the bar to the fence post so that when the coupling device is positioned astraddle the fence post and in contact with a projection of the fence post and with the cross member of the bar, manual force applied downward in the area of the second end of the bar exerts a much greater force upward on the fence post.

1 Claim, 5 Drawing Figures

METAL FENCE POST PULLER

BACKGROUND OF THE INVENTION

The present invention relates to a metal fence post puller. More particularly, the invention relates to a metal fence post puller for pulling a metal fence post from the ground, which fence post has projections extending therefrom.

Fence post pullers similar to that disclosed herein are described in U.S. Pat. Nos. 527,514; 975,600; 1,260,041; 1,844,809; 2,766,608 and 3,331,586.

Objects of the invention are to provide a metal fence post puller of simple structure, which is inexpensive in manufacture, used with facility, convenience and minimal effort, and functions efficiently, effectively and reliably to remove a metal fence post, from the ground, without damage to the post, and with a minimum expenditure of energy by the user.

The metal fence post puller of the invention is especially adaptable for use in removing metal fence posts used on farms. The posts are usually destroyed or badly damaged when removed, and require a considerable expenditure of effort on the part of the person removing the fence post. It is important to the farmer to salvage the removed fence post intact, since the fence posts are used in great numbers and involve a considerable expense when lost.

BRIEF DESCRIPTION OF THE DRAWINGS

In order that the invention may be readily carried into effect, it will now be described with reference to the accompanying drawings; wherein.

DETAILED DESCRIPTION OF THE INVENTION

Figure 1:
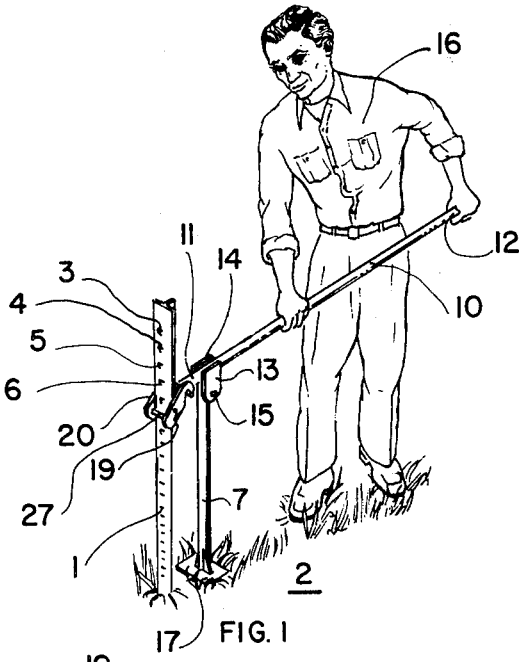
FIG. 1 is a perspective view of an embodiment of the metal fence post puller of the invention in use.

The metal fence post puller of the invention functions to pull or remove a metal fence post 1 (FIG. 1) from the ground 2 (FIG. 1). The fence post 1 has a plurality of spaced projections 3, 4, 5, 6, and so on (FIG. 1) extending therefrom. These projections support the fence during normal use of the fence post. That is, the projections 3 to 6, and so on, of the fence post 1 support wire, barbed wire, or the like, which constitutes the actual fence.

Figure 4:
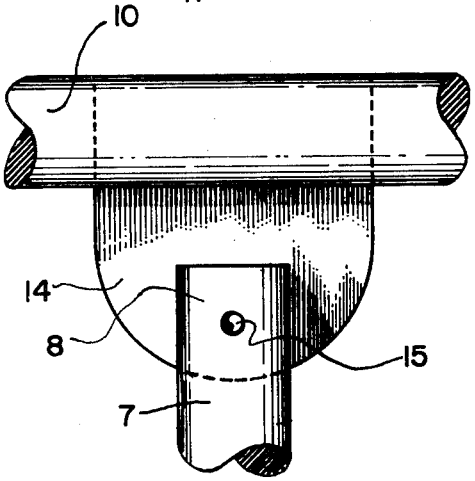
FIG. 4 is a view, on an enlarged scale, of a member affixing the elongated bar to the support member of the metal fence post puller of the invention.
Figure 5:
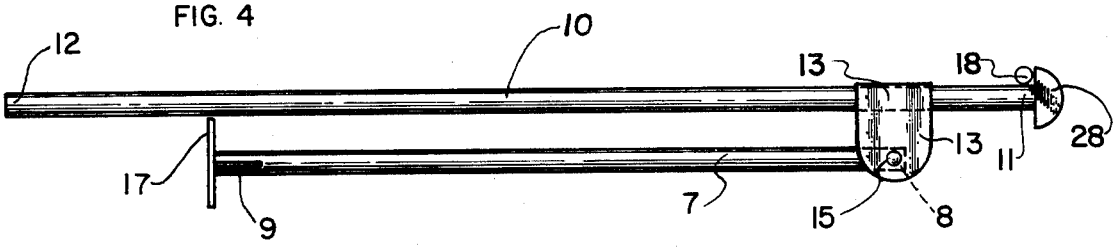
FIG. 5 is a view, on an enlarged scale, of the metal fence post puller of the embodiment of FIG. 1.

The metal fence post puller of the invention comprises a shaft-like support member 7 (FIGS. 1, 4 and 5) having spaced opposite first and second ends 8 and 9, respectively, as shown in FIG. 5.

An elongated bar 10 has spaced opposite first and second ends 11 and 12, respectively (FIGS. 1 and 5). A pair of bracket members 13 and 14 are affixed to the elongated bar 10 in the area of the first end 11 thereof in spaced parallel diametrically opposed relation, as shown in FIGS. 1, 4 and 5. The bracket members 13 and 14 are pivotally affixed to the first end 8 of the support bar 7 via a pivot pin 15 (FIGS. 1, 4 and 5). The bar 10 is thus rotatable in the plane of said bar and the support member 7 in directions toward and away from said support member when manually gripped by a user 16 at the second end 13 of the bar. In the view of FIG. 1, movement of the bar 10 in directions toward the support member 7 is clockwise, whereas movement of said bar in directions away from said support member is counterclockwise.

A base plate 17 (FIGS. 1 and 5) is affixed to the second end 9 of the support member 7 and extends perpendicularly thereto for supporting said support member in an upright position adjacent the metal fence post 1, as shown in FIG. 1.

Figure 2:
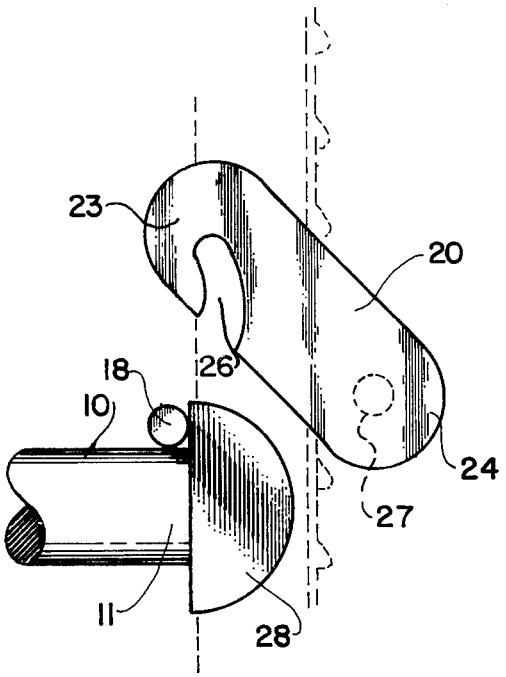
FIG. 2 is a view, on an enlarged scale, of an embodiment of the coupling device of the metal fence post puller of FIG. 1, explaining their interrelation in raising a fence post.
Figure 3:
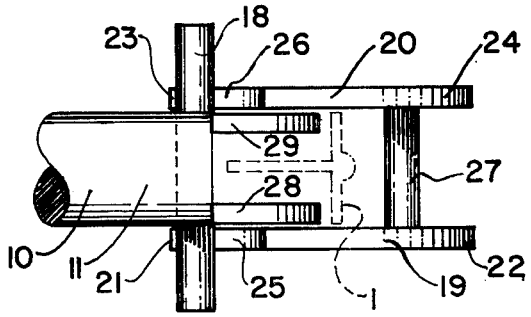
FIG. 3 is a view, on an enlarged scale, of the coupling device of FIGS. 1 and 2 of the metal fence post puller of the invention.

A rod-like cross member 18 is affixed to the elongated bar 10 at the first end 11 thereof, as shown in FIGS. 2, 3 and 5, and extends perpendicularly from said bar.

A coupling device comprises a pair of flat bar members 19 and 20. The flat bar member 19 has spaced opposite first and second ends 21 and 22, respectively (FIG. 3), and the flat bar member 20 has spaced opposite first and second ends 23 and 24, respectively, as shown in FIGS. 2 and 3. A downwardly opening slot 25 is formed in the area of the first end 21 of the flat bar member 19, as shown in FIG. 3, and a downwardly opening slot 26 is formed in the area of the first end 23 of the flat bar member 20, as shown in FIGS. 2 and 3.

A rod-like connecting member 27 (FIGS. 1 to 3) is affixed to the flat bar members 19 and 20 in the area of the second ends 22 and 24, respectively, thereof and maintains said flat bar members in spaced parallel relation, as shown in FIGS. 1 and 3.

When the flat bar members 19 and 20 are positioned astraddle the fence post 1, as shown in FIG. 1, with the connecting member 27 under a projection 3 to 6, and so on, of said fence post, and with the cross member 18 of the elongated bar 10 in the slots 25 and 26 of said flat bar members, manual force applied downward in the area of the second end 12 of said elongated bar exerts a much greater force upward on the fence post and removes said fence post from the ground with a minimum effort.

Semidisc-like plates 28 and 29 (FIG. 3) are affixed to the first end 11 of the elongated bar 10 to prevent damaging of the fence post 1 during rotation of said elongated bar.

While the invention has been described by means of a specific example and in a specific embodiment, I do not wish to be limited thereto, for obvious modifications will occur to those skilled in the art without departing from the spirit and scope of the invention.

I claim:

1. A metal fence post puller for pulling a metal fence post from the ground, the fence post having projections extending therefrom, said metal fence post puller comprising a shaft-like support member having spaced opposite first and second ends;

an elongated bar having spaced opposite first and second ends having a pair of bracket members affixed thereto in the area of the first end thereof in spaced parallel diametrically opposed relation, said bracket members being pivotally affixed to the first end of the support member whereby said bar is rotatable in the plane of said bar and said support member in directions toward and away from said support member when manually gripped at the second end of said bar;

a base plate affixed to the second end of the support member and extending perpendicularly thereto for supporting said support member in upright position adjacent a metal fence post;

a rod-like cross member affixed to said bar at the first end thereof and extending perpendicularly therefrom; and coupling means for coupling said bar to the fence post, said coupling means comprising a pair of flat bar members each having spaced opposite first and second ends and a bottom edge extending between and joining said ends with a downwardly opening slot formed therein in the area of the first end and extending from the bottom edge at an acute angle therewith and a rod-like connecting member affixed to said flat bar members in the area of the second ends thereof and maintaining said flat bar members in spaced parallel relation whereby when said flat bar members are positioned astraddle the fence post with the connecting member under a projection of said fence post and with the cross member of said elongated bar in said slots, manual force applied downward in the area of the second end of said elongated bar exerts a much greater force upward on said fence post.

* * * * *